United States Patent [19]

Silvestri, Jr. et al.

[11] Patent Number: 4,557,113

[45] Date of Patent: Dec. 10, 1985

[54] SINGLE LOW PRESSURE TURBINE WITH ZONED CONDENSER

[75] Inventors: George J. Silvestri, Jr., Winter Park; Joseph Davids, Maitland, both of Fla.

[73] Assignee: Westinghouse Electric Corp., Pittsburgh, Pa.

[21] Appl. No.: 621,323

[22] Filed: Jun. 15, 1984

[51] Int. Cl.[4] ..... F28B 7/00

[52] U.S. Cl. ..... 60/693; 60/685; 415/101

[58] Field of Search ..... 60/685, 692, 693; 415/101

[56] References Cited

U.S. PATENT DOCUMENTS

| | | | |
|---|---|---|---|
| 1,372,929 | 3/1921 | Baumann et al. | 60/693 |
| 4,306,418 | 12/1981 | Nishioka | 60/693 |
| 4,353,217 | 10/1982 | Nishioka et al. | 60/693 |

*Primary Examiner*—Stephen F. Husar

*Attorney, Agent, or Firm*—F. J. Baehr, Jr.

[57] ABSTRACT

A low pressure double flow stream turbine is connected to a condenser and partition plates are disposed within the condenser and turbine to flow to two separate chambers and cooling water flows in series through tubes in the separate chambers producing different back pressures, the last row of rotating blades which discharge into the lower pressure chamber are longer than the last row of blades which discharge into the higher pressure chamber resulting in an improvement in the heat rate of the turbine.

3 Claims, 5 Drawing Figures

SINGLE LOW PRESSURE TURBINE WITH ZONED CONDENSER

BACKGROUND OF THE INVENTION

This invention relates to zoned condensers and more particularly to a zoned condenser for a single casing double exhaust turbine. Large turbine generators often have two or three pressure turbine elements, each with double exhausts. For such units zoned or multiple pressure condensers are commonly used and improve the heat rate for two basic reasons; they provide a lower average back pressure and the condensate leaving the condenser has a higher temperature than single pressure condensers. Back pressure of multi-pressure units is lower because the heat rejection per unit length of condenser is more uniform. Thermodynamically this means that heat is transferred at a lower average temperature difference, that is, more efficiently.

Between 1970 and 1977 over 150 turbine generator units with multiple double flow elements used multi-pressure condensers while no known single element, double flow turbine is known to use a zone or multiple pressure condenser which could improve the heat rate up to about 0.7% if zoned or multi-pressure condensers were utilized on single element units.

SUMMARY OF THE INVENTION

In general, a low pressure double flow steam turbine and condenser combination, when made in accordance with this invention, comprises a shell and tube condenser in which cooling water is designed to flow through the tubes and steam to condense on the outer side of the tubes, a turbine housing in fluid communication with the shell side of the condenser, a turbine rotor rotatably disposed in the housing, a steam inlet nozzle generally centrally disposed in the housing, a plurality of stationary and rotatable interdigitated blade rows forming within the turbine two steam flow paths which are directed to opposite axial ends of the turbine and baffling disposed in the condenser and turbine to separate the condenser and turbine into two separate chambers, a low pressure chamber which encloses a portion of the condenser tubes through which influent cooling water is designated to flow and a high pressure chamber which encloses a portion of the condenser tubes through which effluent cooling water is designated to flow, whereby when in operation the chamber having influent cooling water in the tubes will operate at a lower pressure than the chamber having effluent cooling water in the tubes.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
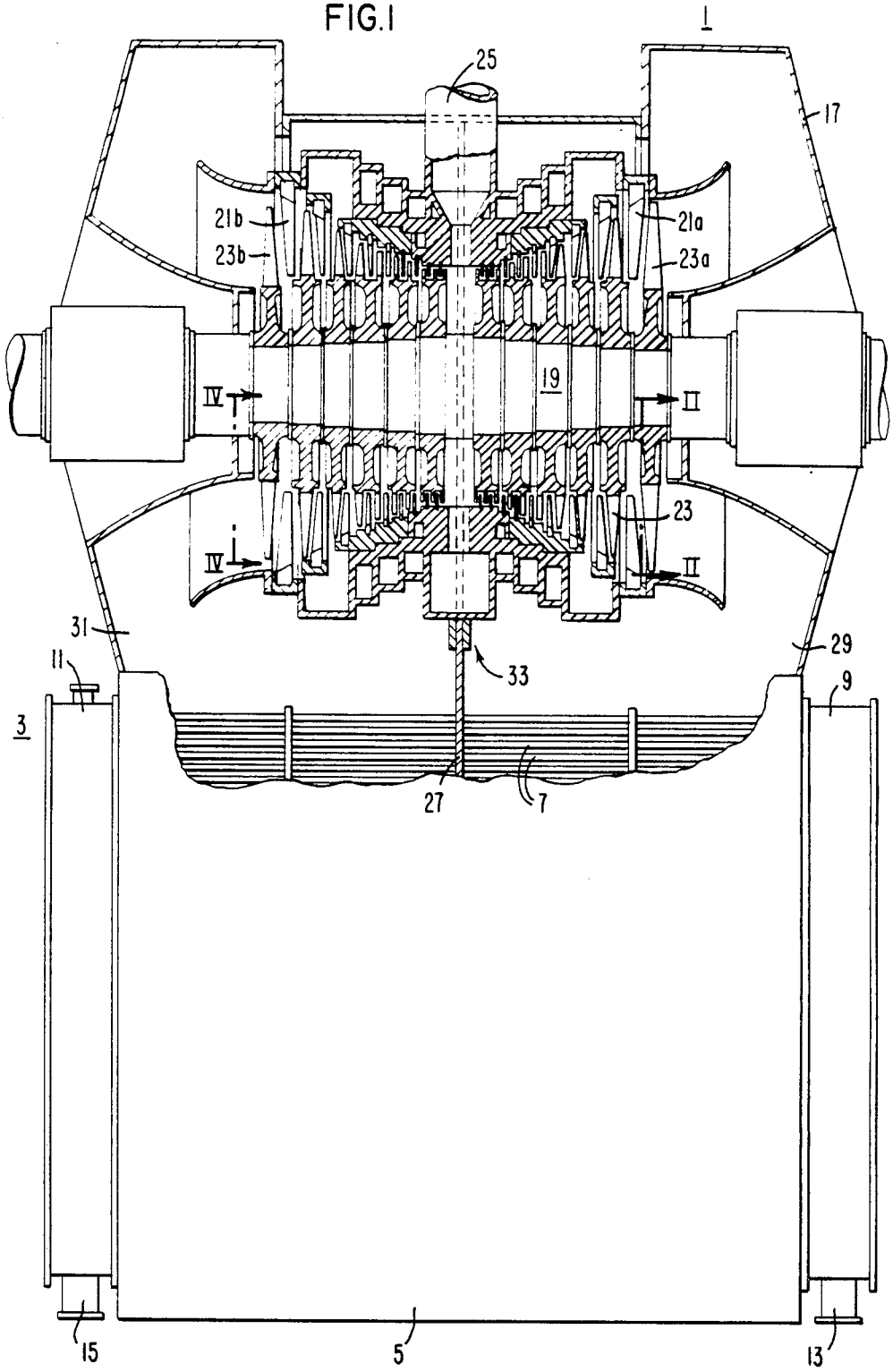
FIG. 1 is an elevational view partly in section of a turbine condenser combination made in accordance with this invention.
Figure 2:
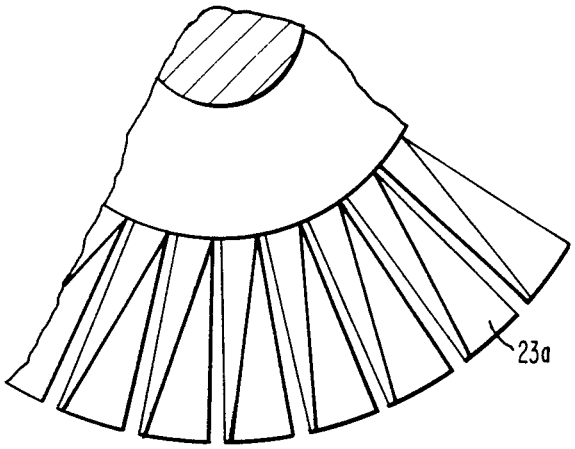
FIG. 2 is a partial sectional view taken on line II—II of FIG. 1.

Referring now to the drawings in detail, and in particular to FIG. 1, there is shown a low pressure double flow steam turbine element and a zoned or multi-pressure condenser 3.

The condenser 3 comprises a shell portion 5 which encloses a plurality of horizontally disposed straight tube 7 with water boxes or headers 9 and 11 disposed on opposite ends of the shell 5 and tubes 7. An inlet cooling water nozzle 13 is disposed in fluid communication with one of the headers 9 and an outlet cooling water nozzle 15 is disposed in fluid communication with the other header 11 so that influent cooling water enters the right hand end of the tubes 7 and effluent cooling water is discharged from the left hand end of the tube 7 as shown in FIG. 1.

The turbine comprises a casing or housing 17 which is disposed in fluid communication with the shell 5 of the condenser 3. Rotatably disposed within the housing 17 is a rotor 19 and a plurality of stationary and rotatable interdigitated blade rows 21 and 23, respectively, forming two steam flow paths which orginate at the central portion of the housing 17 and extend axially in opposite directions to the axial ends of the turbine 1. A steam inlet nozzle 25 is disposed in the center portion of the housing 17 to supply steam to the blade rows in each flow path.

A partition plate or baffle 27, which may include more than one plate, is disposed within the shell 5 and housing 17 so as to form two separate chambers 29 and 31 within the shell 5 and housing 17. The chamber 29 has tubes with influent cooling water flowing therethrough and the chamber 31 has tubes with effluent cooling water flowing therein so that the back pressure in the chamber 29 is lower than the back pressure in the chamber 31 which are, respectively, called low and high pressure chambers 29 and 31. The partition plate 27 may be attached to the condenser or turbine housing by welding on one side and provided with a tongue-and-groove arrangement as shown generally at 33 wherever necessary to allow for thermal expansion of the partition plate 27.

The last row of rotatable blades **23*a* on the right hand end of the steam flow path which discharge into the low pressure chamber 29 are longer than the last row of rotatable blades 23*b* on the left hand side of the steam flow path which discharges into the high pressure chamber 31, and may include corresponding changes in the last row of stationary blades 21*a* and 21*b***.

Figure 3:
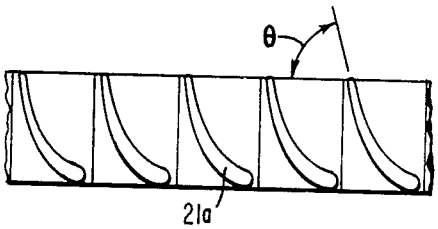
FIG. 3 is a schematic view showing gauging of the blades.
Figure 4:
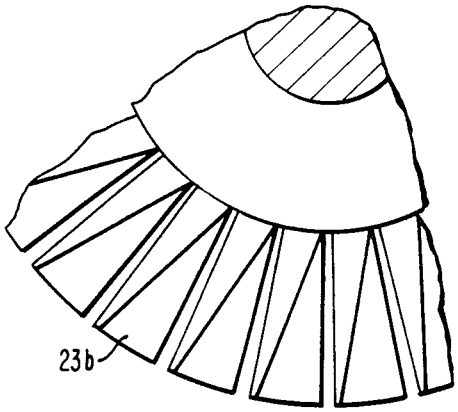
FIG. 4 is a partial sectional view taken on line IV—IV of FIG. 1.
Figure 5:
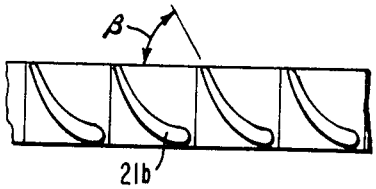
FIG. 5 is a schematic view showing gauging of the blades.

The gauging as indicated by the angle $\theta$ of the last row of stationary blades **21*a* or rotating blades 23*a* on the right hand end of the steam flow path as shown in FIG. 3 is greater than the gauging as shown by the angle B in the last row of stationary blades 21*b* or rotating blades 23*b* in the flow path on the left hand side of the turbine as shown in FIG. 5**. The gauging of the last row of rotatable blades may also be changed but since there are many more variables when dealing with rotatable blades, the change is much more complicated.

Changing the gauging of the last rows of rotating and/or stationary blades may be implemented without changing the length thereof and vice versa, or the length and gauging may both be changed depending on the turbine steam flow and cooling water temperatures.

The zoned or multi-pressure condenser and turbine combination hereinbefore described will have up to 0.7% better thermal performance than units without multiple pressure or zoned condensers and it is understood that units with multiple low pressure double flow turbine units may also utilize this invention to allow an even greater number of zones in the multiple turbine elements and this invention would improve their efficiency.

What is claimed is:

1. A low pressure double flow steam turbine and condenser combination comprising:

a shell and tube condenser in which cooling water is designated to flow through the tubes and steam to condense on the outer side of the tube;

a turbine housing in fluid communication with the shell side of the condenser;

a turbine rotor rotatably disposed within said housing;

a steam inlet nozzle generally centrally disposed in said housing;

a plurality of stationary and rotatable interdigitated blade rows forming within said turbine two steam flow paths which originate adjacent the inlet nozzle and are directed to opposite ends of said turbine;

baffling disposed in said condenser and turbine to separate said condenser and turbine into two separate chambers, a low pressure chamber which encloses a portion of said condenser tubes through which influent cooling water is designated to flow and a high pressure chamber which encloses a portion of said condenser tubes through which effluent cooling water is designated to flow, whereby when in operation said chamber having influent cooling water in the tubes will operate at a lower pressure than said chamber having effluent cooling water in the tubes; the gauging of the last row of stationary blades in the steam flow path to the low pressure chamber is greater than the gauging in the last row of the stationary blades in the steam flow path to the high pressure chamber.

2. A low pressure double flow steam turbine and condenser combination as set forth in claim 1, wherein the last row of rotating blades in the steam flow path to the lower pressure chamber are longer blades than the blades of the last row of rotatable blades in the steam flow path to the high pressure chamber.

3. A low pressure double flow steam turbine and condenser combination as set forth in claim 1, wherein the gauging of the last row of rotating blades in the steam flow path to the low pressure chamber is greater than the gauging in the last row of rotating blades in the flow path to the high pressure chamber.

* * * * *